US008581131B2

(12) United States Patent
Pollmann

(10) Patent No.: US 8,581,131 B2
(45) Date of Patent: Nov. 12, 2013

(54) MODULAR TERMINAL, PARTICULARLY AN ISOLATING TERMINAL

(75) Inventor: Carsten Pollmann, Steinheim (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 472 days.

(21) Appl. No.: 12/922,633

(22) PCT Filed: Mar. 12, 2009

(86) PCT No.: PCT/EP2009/001792

§ 371 (c)(1),
(2), (4) Date: Nov. 8, 2010

(87) PCT Pub. No.: WO2009/112264

PCT Pub. Date: Sep. 17, 2009

(65) Prior Publication Data

US 2011/0062011 A1 Mar. 17, 2011

(30) Foreign Application Priority Data

Mar. 14, 2008 (DE) ..... 10 2008 014 176

(51) Int. Cl.
*H01H 21/54* (2006.01)

(52) U.S. Cl.
USPC ..... 200/554; 200/244; 218/32

(58) Field of Classification Search
USPC ..... 200/554, 248, 244, 293; 218/16–22, 218/30–32
See application file for complete search history.

(56) References Cited

U.S. PATENT DOCUMENTS

| | | | | |
|---|---|---|---|---|
| 2,620,415 | A | 12/1952 | Lewis | |
| 3,840,717 | A | 10/1974 | Pekrul et al. | |
| 5,669,788 | A * | 9/1997 | Brockman | 439/511 |
| 7,005,594 | B2 * | 2/2006 | Kim | 200/244 |
| 7,189,935 | B1 * | 3/2007 | Hassan et al. | 200/244 |
| 8,128,430 | B2 * | 3/2012 | Diessel | 439/507 |
| 2011/0059658 | A1 * | 3/2011 | Eisert et al. | 439/716 |

FOREIGN PATENT DOCUMENTS

| | | |
|---|---|---|
| DE | 41 06 555 A1 | 9/1991 |
| DE | 44 44 551 A1 | 6/1996 |

* cited by examiner

*Primary Examiner* — Amy Cohen Johnson
*Assistant Examiner* — Marina Fishman
(74) *Attorney, Agent, or Firm* — Roberts Mlotkowski Safran & Cole, P.C.; David S. Safran

(57) ABSTRACT

A modular terminal that has a terminal housing, a busbar composed of two sections, two terminal elements for connecting a conductor to each section of the busbar, and an isolating blade which is pivotally mounted in the terminal housing. The two sections are interconnected in a first position of the isolating blade while being disconnected from each other in a second position of the isolating blade. The ends of the sections of the busbar which face away from the terminal elements are bent in such a way that the end of the first section of the busbar contacts the isolating blade in an upper contact zone while the end of the second section (4) of the busbar contacts the isolating blade in a lower contact zone in the first position of the isolating blade.

18 Claims, 8 Drawing Sheets

MODULAR TERMINAL, PARTICULARLY AN ISOLATING TERMINAL

BACKGROUND OF THE INVENTION

1. Field of the Invention

The invention relates to a modular terminal, especially an isolating terminal, with a terminal housing, with a busbar formed of two sections, with two terminal elements for connecting a respective conductor to a section of the busbar and with an isolating blade which is pivotally mounted in the terminal housing, the two sections being connected to one another in a first position of the isolating blade and being separated from one another in a second position of the isolating blade, and the ends of the sections of the busbar facing away from the terminal elements being bent such that, in the first position of the isolating blade, the end of the first section of the busbar makes contact with the isolating blade on an upper contact region and the end of the second section of the busbar makes contact with the isolating blade on a lower contact region. In addition, the invention relates to a longitudinal circuit breaker with an isolating blade for pivoting arrangement in the terminal housing of a modular terminal.

2. Description of Related Art

Electrical modular terminals have been known for decades and are used in the millions in the wiring of electrical systems and devices. The terminals are generally locked onto support rails which for their part are often located in a plurality in the switching cabinet. The terminal elements in modular terminals are mainly screw-type terminals or tension spring terminals. In addition, however, insulation piercing connecting devices or leg spring terminals can also be used.

The basic type of modular terminal is the connecting terminal which has at least two terminal elements which are electrically connected to one another via an electrically conductive connecting rail, the busbar. In addition to this basic type which is often called a feed-through terminal, there is a host of different modular terminal types which are matched especially to the respective application. Examples are protective-conductor terminals, isolating blade terminals and installation terminals.

In particular, for modular terminals which are used in current transformer measurement circuits in power generation and distribution, various switching, isolating and testing tasks must often be performed. According to their use, these modular terminals are often also called measurement transformer isolating terminals. By using a longitudinal circuit breaker located in the terminal housing of the isolating terminal, the two sections of the busbar can be alternately connected to one another or separated from one another.

An electrical modular terminal in which two sections of a busbar can be separated via a gap is disclosed in German Patent Application DE 41 06 555 A1. The modular terminal described there is a two-tier terminal which has two busbars which run over one another in the terminal housing, the two busbars being separable by a gap which is accessible hum the top of the modular terminal. The gap is made as a blade gap which has an isolating blade which is pivotally mounted in a housing.

German Patent Application DE 44 44 551 A1 discloses a current transformer isolating terminal in which the gap is formed by a contact washer which is arranged to be able to pivot in the terminal housing. Making the gap as a contact washer makes it possible to alternately connect the two sections of the busbar to one another or separate them from one another. If the two sections of the busbar are separated from one another, the transformer-side section of the busbar is connected in an electrically conductive manner to a contact tip which is located additionally in the terminal housing via the contact washer, and a short circuit jumper can be plugged into this contact tip. By making the gap as a contact washer, this isolating terminal has relatively large dimensions. Moreover, the actuating angle for reliable pivoting of the contact washer out of the first position into the second position is relatively large.

The initially described isolating terminal is known from practice; in it the gap is formed by an isolating blade which is pivotally mounted in the terminal housing. The isolating blade is supported at its bottom end in a receiver in the terminal housing so that the isolating blade can be pivoted around this bearing point. While the isolating blade, in the first position makes contact with the two sections of the busbar, the isolating blade in the second position makes contact only with one of the two sections, so that the busbar is separated. To ensure a sufficiently large isolating distance between the isolating blade and the end of the second section facing away from the terminal element, a relatively large actuation angle is also necessary in this isolating terminal.

Moreover, in practice, contact separators are often used as longitudinal circuit breakers which are arranged to be able to move axially in the terminal housing and in the first position connect the two sections to one another. The longitudinal circuit breaker is fixed in its respective position using a screw.

SUMMARY OF THE INVENTION

Therefore, the object of this invention is provide the initially described modular terminal in which the longitudinal circuit breaker can be switched in as space-saving a manner as possible, but still in a user-friendly and reliable manner. In addition, the object of the invention is to devise a longitudinal circuit breaker which is suitable for this purpose with an isolating blade for pivoting arrangement in the terminal housing of a modular terminal.

This object is achieved in a modular terminal of the initially described type in that the pivoting axis of the isolating blade is located between the upper contact region and the lower contact region and that in the second position of the isolating blade both the end of the first section of the busbar is spaced apart from the upper contact region of the isolating blade and also the end of the second section of the busbar is spaced apart from the lower contact region of the isolating blade.

Shifting the pivoting axis of the isolating blade from the lower end upward first reduces the required actuating angle for pivoting the isolating blade out of the first position into the second position. In addition, the required actuating angle is reduced in that, in the second open position of the isolating blade, both the end of the first section of the busbar is spaced apart from the upper contact region and also the end of the second section of the busbar is spaced apart from the lower contact region of the isolating blade. Thus, there is an isolating distance between the end of the first section and the upper contact region and an isolating distance between the end of the second section and the lower contact region, the two isolating distances adding up to a total isolating distance which ensures reliable separation of the two sections of the busbar even at a small actuating angle. Thus, a longitudinal circuit breaker or an isolating blade is available which requires only relatively little space within the terminal housing of the modular terminal so that the modular terminal can be made altogether very compact.

The required actuating angle and thus the space required for the isolating blade within the modular terminal can be further reduced by the isolating blade being angled according to one advantageous configuration of the invention such that the region of the isolating blade located underneath the pivoting axis is bent away from the end of the second section of the busbar. The geometry of the isolating blade thus reduces the isolating distance between the lower contact region and the end of the second section of the busbar so that a smaller actuating angle is necessary to ensure a certain overall isolating distance between the two sections of the busbar.

According to one preferred configuration of the invention, the isolating, blade is partially jacketed by the insulating housing, at least the upper contact region and the lower contact region not being surrounded by the insulating housing, and thus, they can make contact with the ends of the two sections, which ends are made as contact forks, in the first position of the isolating blade. According to the preferred configuration, the longitudinal circuit breaker thus is formed of the isolating blade and the insulating housing. Because the isolating blade is partially jacketed by the insulating housing, both actuation and also mounting of the longitudinal circuit breaker can be facilitated. Specifically, the isolating blade with the insulating housing can be advantageously inserted into the terminal housing and locked in a defined manner there.

The modular terminal in accordance with the invention can thus be marketed as a kit comprised of the terminal housing with the busbar which is formed of two parts and which is located in it, and with the terminal elements, on the one hand, and the longitudinal circuit breaker on the other, then the longitudinal circuit breaker being locked into the terminal housing only when the modular terminal is mounted.

To implement the desired pivoting capacity of the isolating blade within the terminal housing it is advantageously further provided that a pivot is molded on at least one side surface of the insulating housing and in the mounted state of the longitudinal circuit breaker locks in an opening in one side wall of the terminal housing. The guidance of the insulating housing in the terminal housing can be further improved by the insulating housing being dimensioned such that it especially has a width such that when pivoted out of the first position into the second position it is additionally guided by the side walls of the terminal housing. Between the insulating housing and the side walls of the terminal housing, preferably, a light interference fit is implemented which prevents tilting of the insulating housing, and thus, also of the isolating blade during pivoting. Since the side walls of the terminal housing have only a relatively small wall thickness, the side walls are relatively resilient, so that intentional pivoting of the longitudinal circuit breaker out of the first position into the second position is not obstructed by the interference fit.

According to another advantageous configuration of the invention, it is provided that one or two side walls of the terminal housing have a guide groove and that, on at least one side surface of the insulating housing, a guiding pin or a guide brace is formed, the guide groove or guide grooves being arranged such that the isolating blade is located automatically in the second position after inserting the insulating housing into the terminal housing. Forming the guide grooves and the corresponding guiding pins or guide braces in such a manner ensures that the longitudinal circuit breaker can be inserted into the terminal housing only in a certain alignment. The guiding pin which interacts with a guide groove in the side wall of the terminal housing can advantageously be a pivot molded onto the insulating housing.

According to another advantageous configuration of the invention, it is provided that the insulating housing of the longitudinal circuit breaker on at least one side has a catch journal and that, in the corresponding side wall of the terminal housing, two recesses corresponding to the catch journal are made, in which the catch journal locks in the first position and in the second position of the isolating blade. The catch journal and the recesses are advantageously made such that positive locking occurs both in the first position and also in the second position of the isolating blade, and locking of the catch journal into the recess can be clearly ascertained by acoustic clicking.

For simple actuation of the longitudinal circuit breaker, i.e., for pivoting the isolating blade out of the first position into the second position, in the insulating housing an actuating slot which is open to the top is made, into which a tool, especially the tip of a screwdriver, can be inserted. The isolating blade can be easily pivoted out of one locked position into another likewise locked position by the resulting prolongation of the lever arm. The actuating slot is preferably dimensioned such that, to pivot the longitudinal circuit breaker, a screwdriver can be used with which the terminal elements can be actuated, i.e., opened or closed. Moreover, the actuating slot runs preferably laterally offset toward the region of the isolating blade located above the pivoting axis. In this way, the actuating slot can have a great depth, by which the tip of a screwdriver is reliably guided without the insulating housing having to project significantly over the top end of the isolating blade.

The execution of the actuating slot in the insulating housing, moreover, makes it possible, when there are several modular terminals located next to one another, to simultaneously actuate their longitudinal circuit breakers in which a switch connection is used which has at least two legs and a grip section which connects the legs. The individual legs of the switch connection are made such that they can be inserted into a respective actuating slot, and preferably, also locked. In this way, several longitudinal circuit breakers of several modular terminals can be switched at the same time with a single handle.

According to a last advantageous configuration of the modular terminal in accordance with the invention, which will be briefly explained here, there is a lockout device which can be inserted in one position or the other into the terminal housing and locked in it to block the isolating blade. The lockout device is preferably made such that it need be turned only by 180° in order to be able to be inserted into the terminal housing in one position or other positions of the isolating blade. Moreover, it is advantageously provided that the lockout device has an open face side toward the insulating housing in the inserted state so that, with the lockout device inserted, a symbol printed on a face of the plastic housing for identifying the position of the isolating blade is visible from overhead through the lockout device.

With the initially named longitudinal circuit breaker, the object is achieved in that the pivoting axis of the isolating blade is located between the upper contact region and the lower contact region and that, in the second position of the isolating blade, both the upper contact region of the isolating blade is spaced apart from the end of the first section of the busbar and also the lower contact region of the isolating blade is spaced apart from the end of the second section of the busbar. With respect to the advantages and advantageous configurations of the longitudinal circuit breaker, reference is the previous statements on the modular terminal in accordance with the invention.

In particular there is a host of possibilities for embodying and developing the modular terminal in accordance with the invention. In this regard, reference is made to the following description of preferred exemplary embodiments in conjunction with the accompanying drawings.

BRIEF DESCRIPTION OF THE DRAWINGS

FIG. 9 is a sectional view through the middle region of a modular terminal as shown in FIG. 8, with the switch connection plugged in.

DETAILED DESCRIPTION OF THE INVENTION

Figure 1:
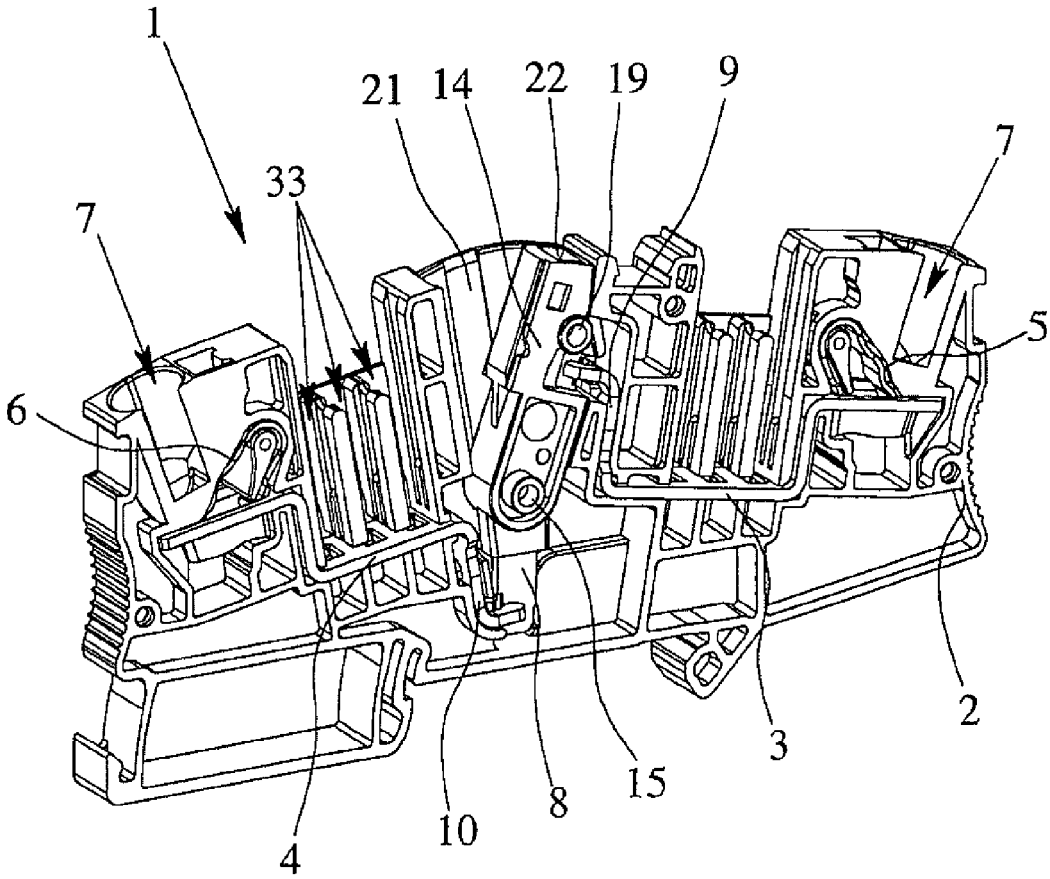
FIG. 1 is a perspective of a modular terminal in accordance with the invention, with a partially omitted side wall.

FIG. 1 shows a modular terminal 1 in accordance with the invention in the form of an isolating terminal which can be used, in particular, as a measurement transformer isolating terminal in current transformer measurement circuits of power generation and distribution. The modular terminal 1 has a terminal housing 2 which generally is made of plastic and in which there are a busbar formed of two sections 3, 4 and two terminal elements 5, 6. The terminal elements 5, 6, in the illustrated embodiment, are made as leg spring terminals into which a conductor to be connected can be plugged through the conductor insertion opening 7 which is made in the terminal housing 2. Moreover, the terminal elements 5, 6 can also be made as screw terminals, as tension spring terminals, or as insulation piercing connection devices. Using the terminal elements 5, 6, a respective electrical conductor can be connected to a section 3, 4 of the busbar.

In the modular terminal 1 shown in FIG. 1, it is possible to alternately connect the two sections 3, 4 of the busbar, and thus, also the conductors connected to the terminal elements 5, 6 to one another or to separate them. For this purpose, in the terminal housing 2, there is a longitudinal circuit breaker which is shown separately in FIG. 4, whose isolating blades 8 can be pivoted out of a first position in which the two sections 3, 4 are connected to one another (FIG. 2) into a second position in which the two sections 3, 4 are separated from one another (FIG. 3).

Figure 2:
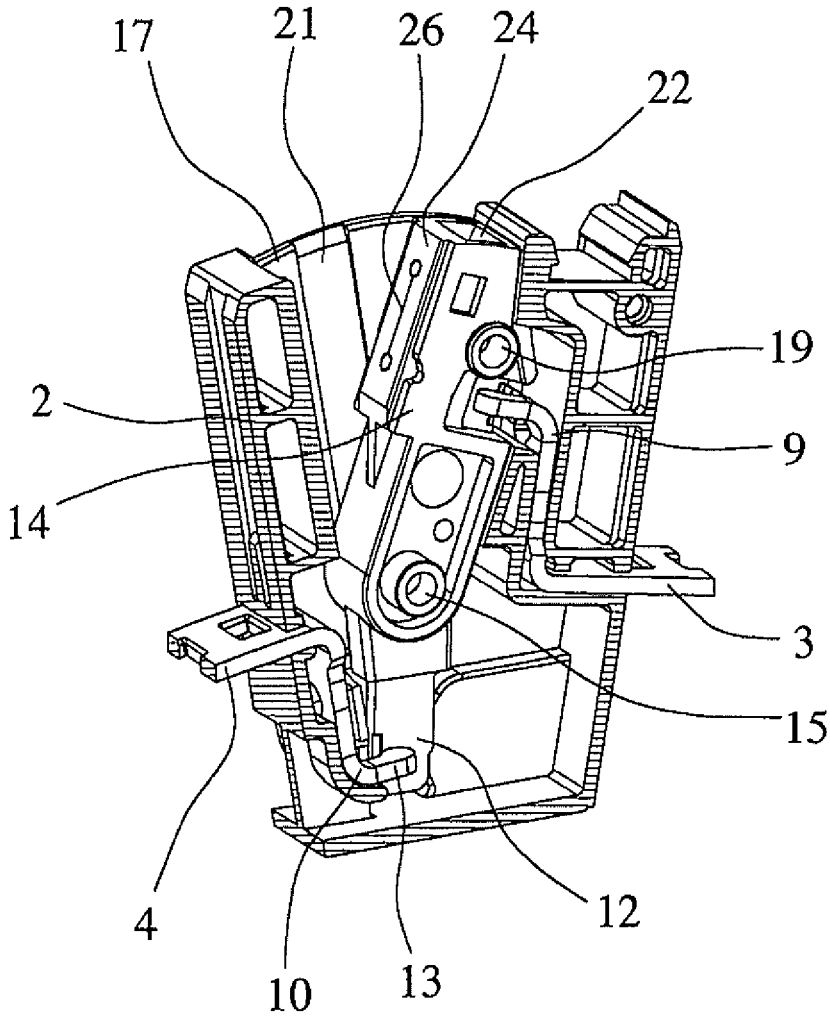
FIG. 2 shows an enlarged view of the middle region of the modular terminal shown in FIG. 1, with a longitudinal circuit breaker in the first position.
Figure 3:
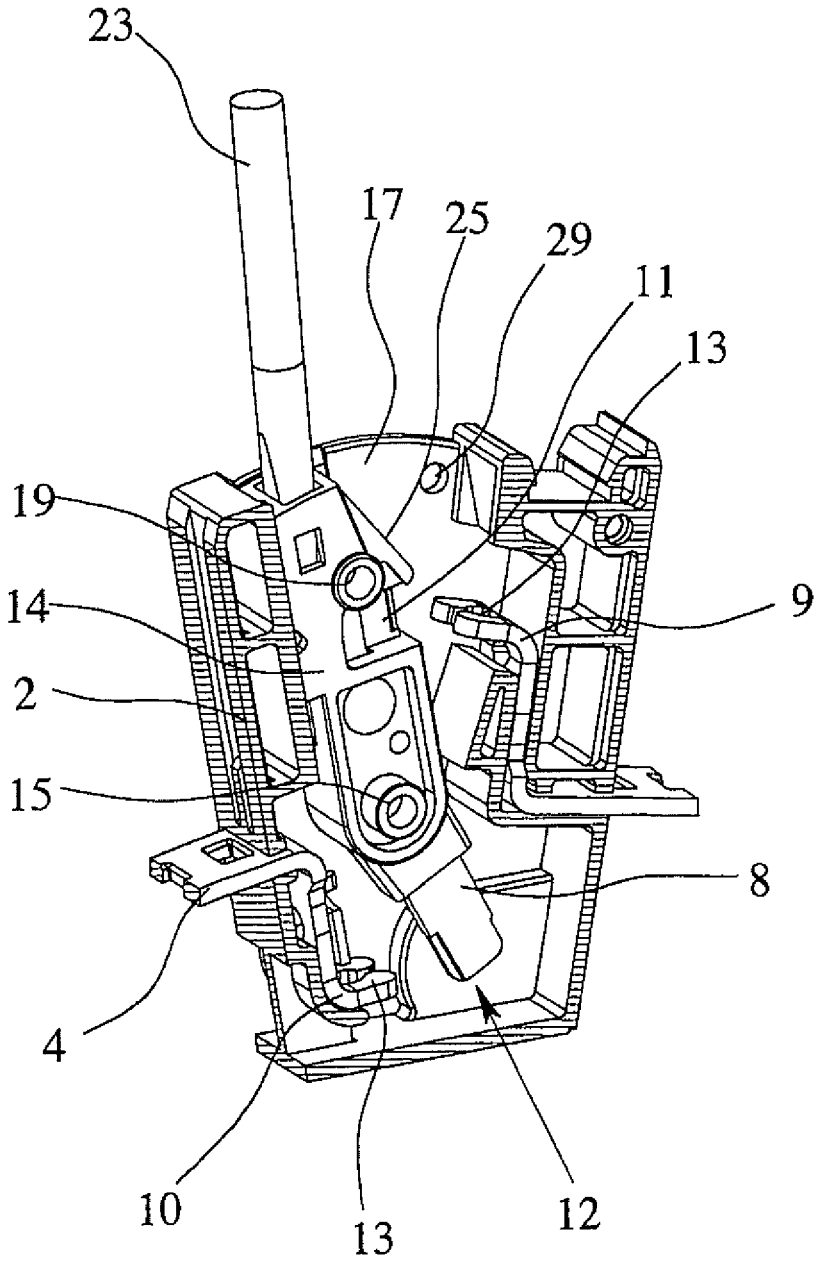
FIG. 3 is an enlarged view of the middle region of the modular terminal as shown in FIG. 1, with a longitudinal circuit breaker in the second position.
Figure 5:
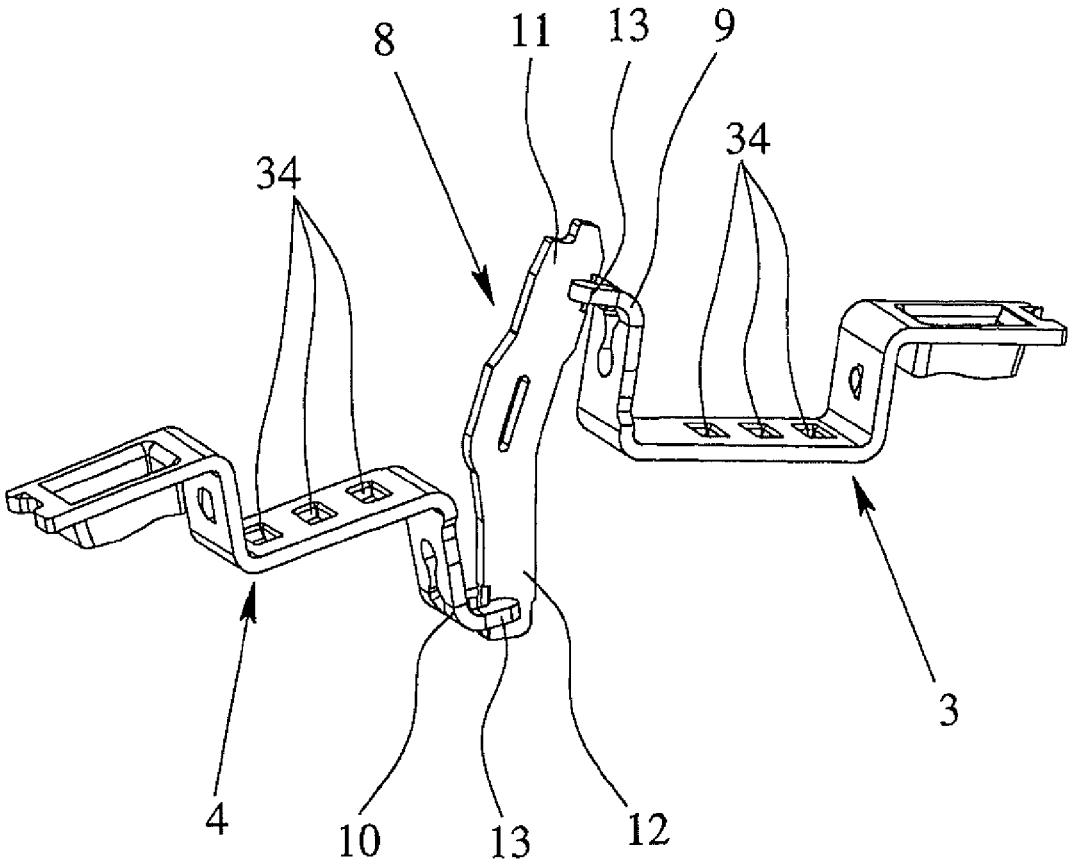
FIG. 5 is a perspective view of the two sections of the busbar of a modular terminal which are electrically connected to one another via the isolating blade.

As is apparent from the figures, especially from FIGS. 2, 3 and 5, the ends 9, 10 of the sections facing 3, 4 away from the terminal elements 5, 6 are bent such that the end 9 of the section 3 is located in the plane above the end 10 of the section 4. Proceeding from the middle region of the sections 3, 4, which runs roughly horizontally, the end 9 of the section 3 is thus bent up and the end 10 of the section 4 is bent down. This leads to the end 9 of the first section of the busbar making contact with the isolating blade 8 on the upper contact region 11 and the end 10 of the second section 4 making contact with the isolating blade 8 on the lower contact region 12 in the first position of the isolating blade 8 shown in FIGS. 1 and 2.

Here, the ends 9, 10 of the two sections 3, 4 of the busbar are each made as contact forks 13 between which the respective contact region 11, 12 of the isolating blade 8 is inserted in the first position, the contact forks 13 and the isolating blade 8 being dimensioned such that reliable and good electrical contact-making is ensured. Moreover, the contact forks 13 are bent or arranged to the isolating blade 8 such that the contact forks 13 meet the two contact regions 11, 12 of the isolating blade 8 almost vertically. In this way, wear on the surface of the isolating blade 8 is minimized and a contact layer applied to the surface of the isolating blade 8 is only slightly scratched.

It was stated above that the longitudinal circuit breaker is pivotally arranged in the terminal housing 2 of the isolating terminal 1. The longitudinal circuit breaker shown separately in FIG. 4, in addition to the isolating blade 8, has an insulating housing 14 which is made such that at least the upper contact region 11 and the lower contact region 12 of the isolating blade 8 are not surrounded by the insulating housing 14. Advantageously, the connection of the isolating blade 8 and the insulating housing 14 is ensured by the isolating blade 8 being jacketed by the insulating housing 14. For pivoting support of the longitudinal circuit breaker or of the isolating blade 8 within the terminal housing 2, a pivot 15 is molded on the side surface of the insulating housing 14 which is supported in the corresponding opening 18 in the side wall 16 of the terminal housing 2.

In addition to support by way of the pivot 15 which is locked in the opening 18, the longitudinal circuit breaker or the insulating housing 14 is also guided by the two side walls 16, 17 of the terminal housing. For this purpose, the width of the insulating housing 14 is chosen such that, in the state inserted into the terminal housing 2, it tightly adjoins the two side walls 16, 17 of the terminal housing 2. Due to this lateral guidance of the insulating housing 14 on the side walls 16, 17 of the terminal housing 2, execution of only one pivot 15 on one side of the insulating housing 14 is sufficient. This leads to the second side wall 17 of the terminal housing being able to be closed, by which adherence to the required air and creepage distances can be more easily ensured.

In the modular terminal 1 in accordance with the invention, the pivot axis of the isolating blade 8, i.e., the pivot 15, is located between the upper contact region 11 and the lower contact region 12. This leads to the required actuating angle for pivoting of the isolating blade 8 out of the first position into the second position being reduced as compared to rotary support of the isolating blade on its lower end. In addition, in the second position of the isolating blade 8—as is especially apparent from FIGS. 3 and 7—both the end 9 of the first section 3 of the busbar is spaced apart from the upper contact region 11 and the end 10 of the second section 4 of the busbar is spaced apart from the lower contact region 12 of the isolating blade 8. Thus, the two isolating distances between the end 9 of the first section 3 and the upper contact region 11, on the one hand, and the end 10 of the second section 4 and the lower contact region 12, on the other, are added into a total isolating distance which ensures reliable separation of the two sections 3, 4 of the busbar.

Figure 7:
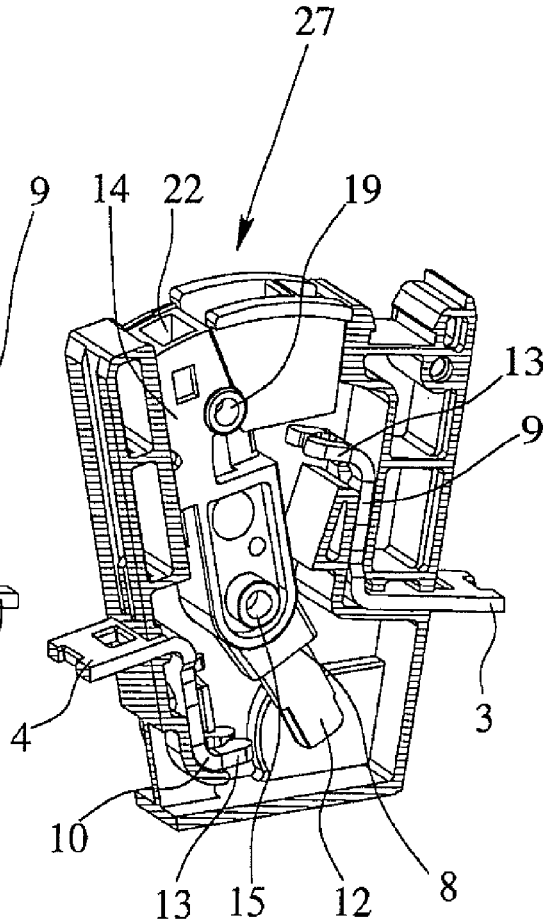
FIG. 7 is an enlarged view of the middle region of the modular terminal, with a longitudinal circuit breaker in the second position, and an inserted lockout device.

Finally, in the illustrated preferred exemplary embodiment, the isolating blade 8 is angled such that the region of the isolating blade 8 located underneath the pivoting axis, i.e., underneath the pivot 5, is bent away from the end 10 of the second section 4, as can likewise be recognized from FIGS. 3 and 7. In this way, an actuating angle of only roughly 30° is altogether sufficient so that on the one hand the middle region of the modular terminal 1—and thus, the modular terminal 1 altogether—can have small dimensions, and on the other hand, actuation of the longitudinal circuit breaker is very easily and conveniently possible even under restricted space conditions.

In the upper region of the insulating housing 14, on the same side on which the pivot 15 is located, a catch journal 19 is additionally molded by which the isolating blade 8 or the longitudinal circuit breaker can be locked in the terminal housing 2 both in the first position and also in the second position. For this purpose, in the side wall 16 of the terminal housing 2 facing the catch journal 19 two recesses 20 are formed in which the catch journal 19 is positively locked in the first position and in the second position of the isolating blade 8. The positive locking of the catch journal 19 in the two recesses 20 together with the narrow guidance of the insulating housing 14 between the two side walls 16, 17 of the terminal housing 2 leads to locking both in the first position and also in the second position being clearly ascertainable by the electrician by acoustic clicking.

Figure 4:
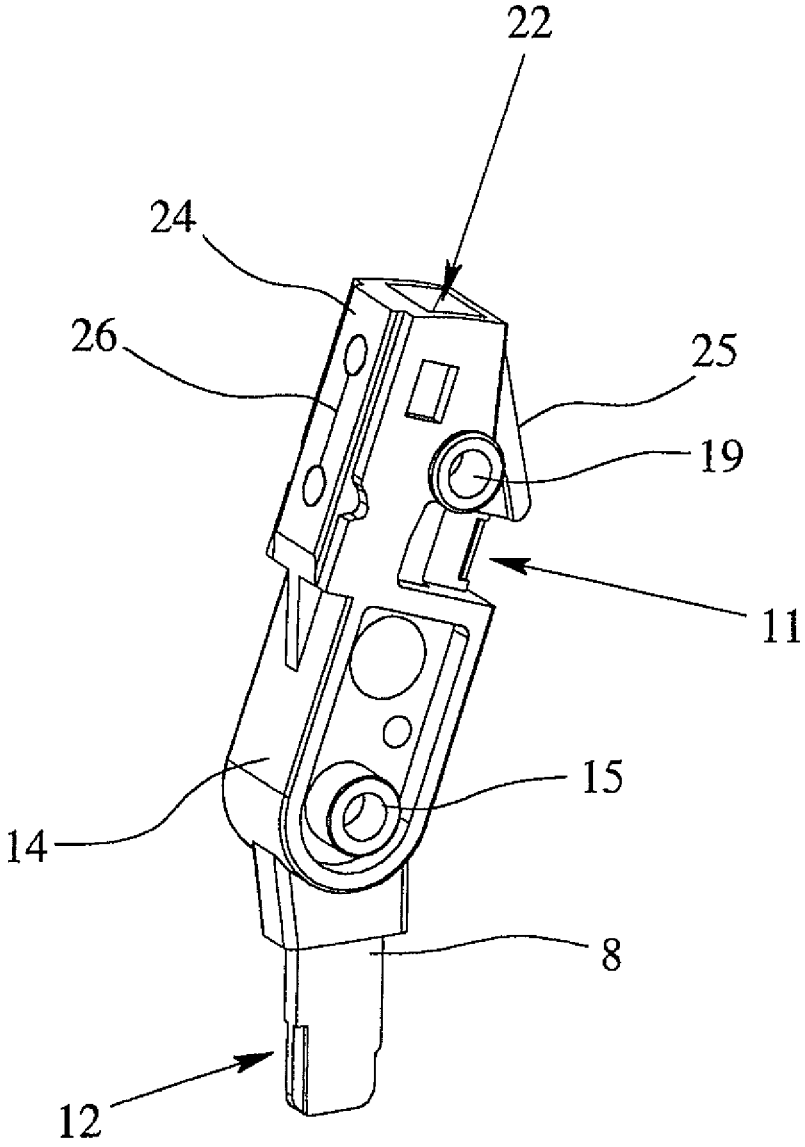
FIG. 4 is a separate representation of the longitudinal circuit breaker.

The longitudinal circuit breaker shown separately in FIG. 4 can be easily mounted in the terminal housing 2 of the modular terminal 1 by the longitudinal circuit breaker being plugged into the terminal housing 2 and locked in it. For this purpose, in the two side walls 16, 17 of the terminal housing 2, a respective guide groove 21 is formed which is engaged, on the one hand, by the pivot 14, and on the other, by a corresponding guiding pin made on the opposite side surface of the insulating housing 14 when the longitudinal circuit breaker is plugged into the terminal housing 2. This ensures that the longitudinal circuit breaker can be plugged into the terminal housing 2 only such that the isolating blade 8 in the locked state of the insulating housing 14 in the terminal housing 2 is located first in the second open position. The insulating housing 14 locks in the terminal housing 2 by the pivot 15 locking into the opening 18 in the side wall 16 of the terminal housing 2; this can be perceived both optically and also acoustically by the corresponding clicking.

In order to facilitate pivoting of the longitudinal circuit breaker out of one position into the other position, in the insulating housing 14 an actuating slot 22 which is open to the top is formed, into which a tool, especially the tip of a screwdriver 23, can be inserted. The actuating slot 22 is dimensioned such that the tip of a screwdriver 23 can be inserted into it, with which the terminal elements 5, 6 can be actuated. Thus, only a single screwdriver is necessary to connect the conductors and to actuate the longitudinal circuit breaker.

FIGS. 2 and 4 show that a symbol 26 is printed on a face 24 of the insulating housing 14 which indicates the respective position of the insulating blade 8 in the modular terminal 1. Since, in FIG. 2, the longitudinal circuit breaker is in the first closed position, on the face 24 of the insulating housing 14 which is visible in this position, the symbol 26 of a closed switch is printed. Corresponding thereto, on the opposite end side 25, the symbol of an open switch is printed. In this way, an electrician can immediately ascertain in which position the longitudinal circuit breaker is located with a brief glance at the top of the terminal housing 2.

Figure 6:
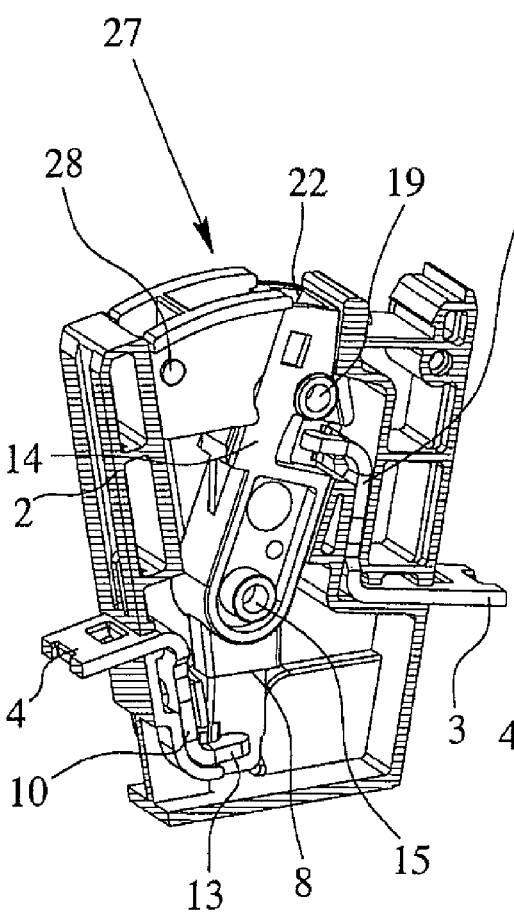
FIG. 6 is an enlarged view of the middle region of the modular terminal, with a longitudinal circuit breaker in the first position, and an inserted lockout device.

FIGS. 6 and 7 show an exemplary embodiment of a modular terminal 1 in which a lockout device 27 is positioned in the terminal housing 2 in a first position (FIG. 6) or in a second position (FIG. 7) and locked in it to block the isolating blade 8. The lockout 27, here, is made such that, after locking into the terminal housing 2, it can only be removed again from the terminal housing 2 with a tool, for example, with pointed pliers, so that unintentional actuation of the longitudinal circuit breaker is reliably prevented. As FIGS. 6 and 7 show, the same lockout 27, both in the first position of the longitudinal circuit breaker and also in the second position of the longitudinal circuit breaker, can be inserted into the terminal housing 2, for which the lockout device 27 need only be turned by 180°. For locking in the terminal housing 2, the lockout device 27, on a side that has a catch journal 28 which, depending on the arrangement of the lockout device 27, locks in an opening 29 in a side wall 16 or the other side wall 17 of the terminal housing 2.

Figure 8:
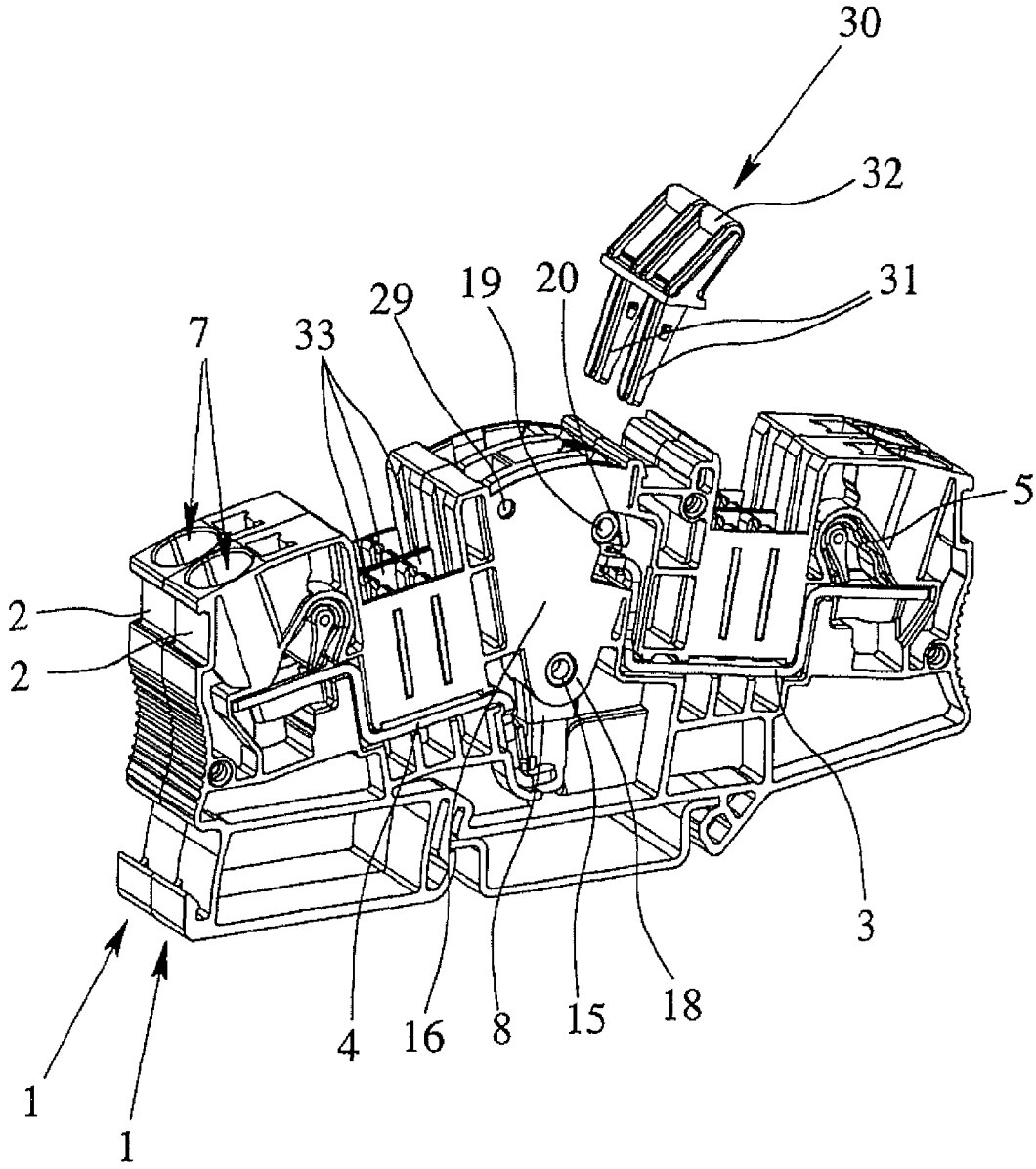
FIG. 8 is a perspective view of two modular terminals located adjacently on the mounting rail.
Figure 9:
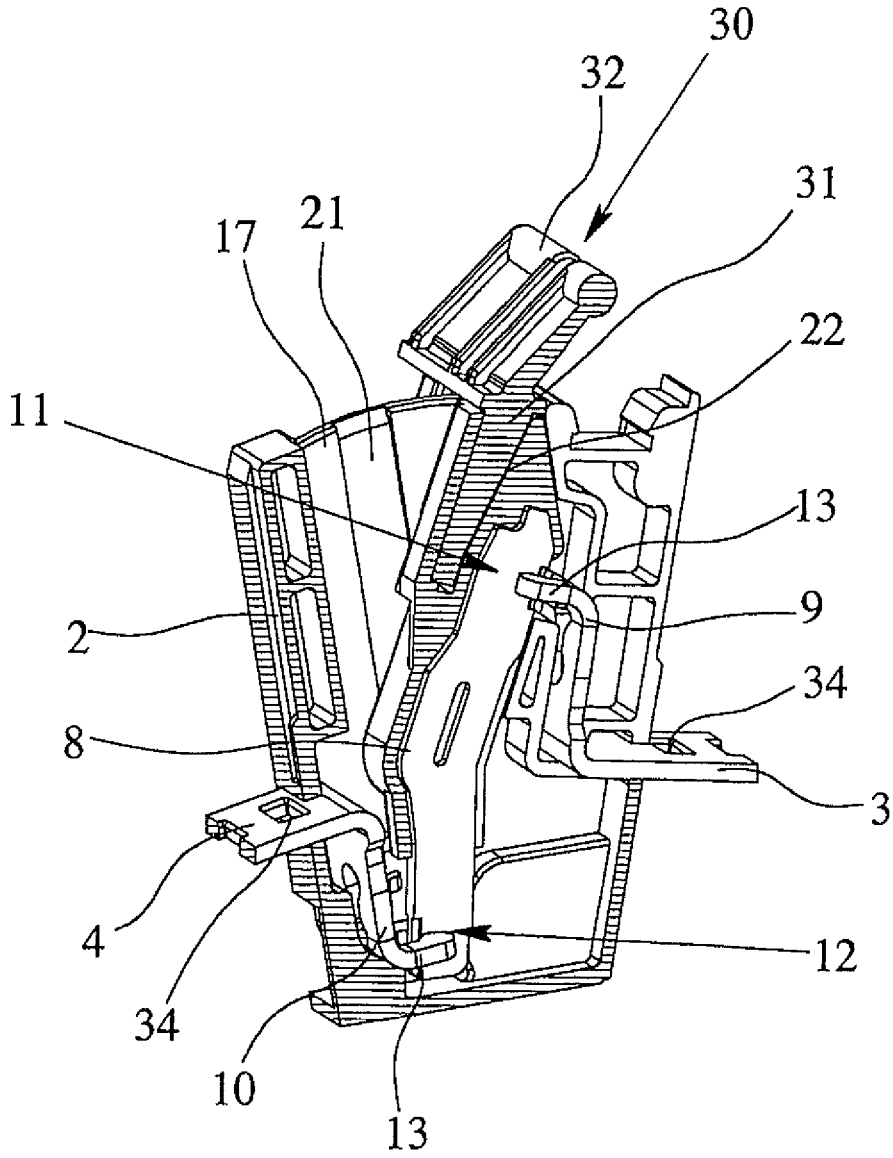

As FIGS. 8 and 9 show, actuation of the longitudinal circuit breaker can take place not only using a screwdriver 23, but also using a switch connection 30 which, in the embodiment shown in FIG. 8, has two legs 31 and a grip section 32 which connects the legs 31. Using this switch connection 30, two longitudinal circuit breakers of two modular terminals 1 which are located next to another can thus be actuated at the same time, for which a respective leg 31 is inserted into the actuating slot 22 of a longitudinal circuit breaker.

Finally, it is apparent from FIGS. 1 and 8 that the modular terminals 1 shown there, on the two sides of the longitudinal circuit breaker, have several guide slots 33 into which the contact pins of a test plug, a test socket, a plug-in jumper or a jumper can be alternately plugged. For contact-making of the contact pins, three respective openings 34 are made in the two sections 3, 4 of the busbar (FIGS. 5).

What is claimed is:

1. A modular terminal, comprising:

a terminal housing with a busbar formed of two sections, two terminal elements for connecting a respective conductor to each section of the busbar and a blade which is pivotally supported in the terminal housing, the two sections being connected to one another in a first position of the blade and being separated from one another in a second position of the blade, and ends of the sections of the busbar facing away from the terminal elements being bent such that the end of the first position of the blade the end of the first section of the busbar makes contact with the blade on an upper contact region and the end of the second section of the busbar makes contact with the isolating blade on a lower contact region, wherein a pivot axis of the isolating blade is located between the upper contact region and the lower contact region and in the second position of the isolating blade, both the end of the first section of the busbar is spaced apart from the upper contact region of the blade and also the end of the second section of the busbar is spaced apart from the lower contact region of the blade, wherein the blade is angled such that the lower contact region of the isolating blade which is located underneath the pivot axis is bent away from the end of the second section of the busbar, so that in the second position of the blade the geometry of the isolating blade increases the isolating distance between the lower contact region of the blade and the end of the second section of the busbar.

2. The modular terminal as claimed in claim 1, wherein the ends of the two sections of the busbar are contact forks.

3. The modular terminal as claimed in claim 1, wherein the isolating blade is partially surrounded by an insulating housing, at least the upper contact region and the lower contact region not being surrounded by the insulating housing, and wherein the insulating housing on a side surface has a pivot and a corresponding opening is provided in a side wall of the terminal housing.

4. The modular terminal as claimed claim 3, wherein the isolating blade is lockable both in the first position and in the second position, for which the insulating housing has a catch journal on one side surface and two corresponding recesses are provided in the side wall of the terminal housing, the catch journal being adapted to lock with acoustic clicking in the first position and in the second position of the blade.

5. The modular terminal as claimed in claim 4, wherein the insulating housing of the isolating blade is dimensioned such that the insulating housing is guided when pivoted out of the first position into the second position by the side walls of the terminal housing.

6. The modular terminal as claimed in claim 5, wherein the isolating blade with the insulating housing can be inserted and locked into the terminal housing, for which at least one side wall of the terminal housing has a guide groove, the guide groove being arranged such that the isolating blade is located in the second position after insertion.

7. The modular terminal as claimed in claim 3, wherein the insulating housing has an actuating slot which is upwardly open and into which a tool can be inserted, the actuating slot running laterally offset relative to a region of the isolating blade which is located above the pivot axis.

8. The modular terminal as claimed in claim 3, wherein on each of two faces of the insulating housing, a symbol for the respective position of the isolating blade is applied such that the symbol can be seen when looking at the top of the terminal housing.

9. The modular terminal as claimed in claim 1, wherein a lockout device is insertable into the terminal housing to block the isolating blade in at least one position thereof, and wherein the lockout device is lockable in the terminal housing such that the lockout device can only be removed again from the terminal housing with a tool.

10. The modular terminal as claimed in claim 8, wherein a lockout device is insertable into the terminal housing to block the blade in at least one position thereof, wherein the lockout device is lockable in the terminal housing such that the lockout device can only be removed again from the terminal housing with a tool, wherein a face of the lockout device that is directed toward the insulating housing in the inserted state of the lockout device is open or transparent so that the symbol on the insulating housing is visible from overhead even with the lockout device inserted.

11. The modular terminal as claimed in claim 7, wherein a switch connection is provided that has at least two legs and a grip section which connects the legs, and wherein one of the legs is insertable into the actuating slot in the insulating housing.

12. The modular terminal as claimed in claim 1, wherein the terminal housing has several guide slots and wherein the busbar has several openings in the two sections for insertion of any one of a contact pin of a test plug, a test socket, a plug-in jumper and a jumper.

13. A longitudinal circuit breaker with a blade for pivoting arrangement in a terminal housing of a modular terminal, the terminal having a busbar formed of two sections, and two terminal elements for connecting a respective conductor to each section of the busbar, wherein the blade has an upper contact region and a lower contact region, wherein a pivot axis of the blade is located between the upper contact region and the lower contact region, and wherein the blade is angled such that a region of the blade located underneath the pivot axis in a position located in the terminal housing is bent away from an end of the second section of the busbar, so that the geometry of the blade increases the isolating distance between the lower contact region of the blade and the end of the second section of the busbar.

14. The longitudinal circuit breaker as claimed in claim 13, wherein the blade is partially surrounded by an insulating housing, at least the upper contact region and the lower contact region not being surrounded by the insulating housing, and wherein the insulating housing has a pivot on a side surface thereof, the pivot being lockable in a corresponding opening in a side wall of the terminal housing.

15. The longitudinal circuit breaker as claimed in claim 13, wherein the blade is partially surrounded by an insulating housing, at least the upper contact region and the lower contact region not being surrounded by the insulating housing, and wherein a side surface of the insulating housing has a catch journal which positively locks in a first corresponding recess in a side wall of the terminal housing in a first position of the isolating blade in the terminal housing and which positively locks in a second corresponding recess in the side wall of the terminal housing in a second position of the isolating blade in the terminal housing.

16. The longitudinal circuit breaker as claimed in claim 13, wherein the blade is partially surrounded by an insulating housing, at least the upper contact region and the lower contact region not being surrounded by the insulating housing, and wherein the insulating housing has an actuating slot which is upwardly open and into which a tool can be inserted, the actuating slot running laterally offset to a region of the isolating blade which is located above the pivot axis.

17. The longitudinal circuit breaker as claimed in claim 14, wherein a symbol indicating a respective position of the isolating blade is located on opposite end sides of the insulating housing.

18. A modular terminal, comprising:

a terminal housing, a busbar formed of two sections and two terminal elements for connecting a respective conductor to each of the sections of the busbar, ends of the sections of the busbar facing away from the terminal elements being bent such that the end of a first of the sections of the busbar is located in a plane above the end of the second of the sections of the busbar, wherein a section disconnector which has an isolating blade is located in the terminal housing and is insertable and lockable such that the two sections are connected to one another in a first position of the isolating blade and are separated from one another in a second position of the isolating blade, and wherein the isolating blade has an upper contact region, a lower contact region, and a pivot axis located between the upper contact region and the lower contact region, the pivot axis being located in the terminal housing, and the isolating blade being angled such that a region of the isolating blade located underneath the pivot axis is bent away from an end of the second of the sections of the busbar.

* * * * *